United States Patent [19]

Cannon

[11] Patent Number: 4,878,854

[45] Date of Patent: Nov. 7, 1989

[54] LAMP BASE

[75] Inventor: Donald M. Cannon, Dover, Pa.

[73] Assignee: GTE Products Corporation, Stamford, Conn.

[21] Appl. No.: 200,217

[22] Filed: May 31, 1988

[51] Int. Cl.[4] ..... H01R 33/02

[52] U.S. Cl. ..... 439/236; 439/612; 313/318

[58] Field of Search ..... 313/318; 439/226, 236, 439/242, 243, 244, 313, 439, 605, 611, 612, 617, 619, 650, 651

[56] References Cited

U.S. PATENT DOCUMENTS

| | | | |
|---|---|---|---|
| 2,395,145 | 2/1946 | Ranney | 176/126 |
| 2,508,118 | 5/1950 | Lemmers | 176/122 |
| 2,659,836 | 11/1953 | Germer | 313/236 |
| 2,683,836 | 7/1954 | Lemmers | 315/46 |
| 2,771,589 | 11/1956 | Thomas | 339/144 |
| 2,799,801 | 7/1957 | Freeman | 315/32 |
| 2,896,187 | 7/1959 | Thomas | 339/145 |
| 2,957,995 | 10/1960 | Fox | 313/109 |
| 2,983,838 | 5/1961 | Pechy | 313/318 |
| 3,014,196 | 12/1961 | Shappell | 339/145 |
| 3,026,443 | 3/1962 | Wilson | 313/318 |
| 3,089,972 | 5/1963 | Larson et al. | 313/34 |
| 3,349,277 | 10/1967 | Terhoeve | 313/318 |
| 3,369,143 | 2/1968 | Gilmore et al. | 313/206 |
| 3,413,511 | 11/1968 | Plagge | 313/318 |
| 3,458,747 | 7/1969 | Gainer et al. | 313/318 |
| 3,525,898 | 8/1970 | Boyce | 313/318 |
| 3,534,216 | 10/1970 | Gilbert, Jr. et al. | 313/318 |
| 4,102,558 | 7/1978 | Krachman | 339/144 |
| 4,324,998 | 4/1982 | Gilmore et al. | 313/318 |
| 4,326,146 | 4/1982 | Plagge et al. | 313/318 |
| 4,570,105 | 2/1986 | Engel | 439/236 |

OTHER PUBLICATIONS

IBM Bulletin, Kryzaniwsky, vol. 14, No. 9, p. 2599, 2-1972.

*Primary Examiner*—Neil Abrams
*Assistant Examiner*—Khiem Nguyen
*Attorney, Agent, or Firm*—William H. McNeill

[57] ABSTRACT

An adapter converts a bi-pin based fluorescent lamp to a recessed double contact based lamp. The adapter has a housing with pin receiving apertures therein adjacent to a central aperture. Each pin receiving aperture contains a contact which has a portion which frictionally engages a pin.

4 Claims, 2 Drawing Sheets

LAMP BASE

CROSS-REFERENCE TO RELATED APPLICATIONS

This application contains subject matter similar to U.S. Ser. No. 200,216, filed 5-31-88, by the same inventor and assigned to the assignee of this application.

TECHNICAL FIELD

This invention relates to bases for electric lamps and more particularly to bases for fluorescent lamps. Still more particularly, it relates to an adapter for converting a bi-pin fluorescent base to a recessed, double contact base.

BACKGROUND ART

In the manufacture of fluorescent lamps, the lamp envelope is usually provided with a base at each end. Generally, the base comprises a shell secured to an end of the lamp envelope. An insulating disk is fixed in the shell and carries a pair of hollow pins into which the lamp lead wires are secured, such as by welding or soldering for example. The lamp is supported by a pair of suitable lamp holders or sockets into which the lamp bases extend for connection to a source of electrical energy. Such lamps are generally called bi-pin base lamps and are among the most common designs.

Occasionally, the starting and/or electrical characteristics of certain fluorescent lamps are such that, in designing a base, consideration must be given to the inclusion of safety features to eliminate the danger of electrical shock. At least one such lamp type is known by its base, which is called a recessed double contact or RDC type. One such lamp and base are shown in U.S. Pat. No. 2,896,187.

The latter lamps tend to be more expensive than the bi-pin type, in part because of the expense of maintaining an inventory of two different types of bases.

DISCLOSURE OF THE INVENTION

It is, therefore, an object of this invention to obviate the disadvantages of the prior art.

It is another object of the invention to enhance fluorescent lamps.

These objects are accomplished, in one aspect of the invention, by the provision of an adapter for converting a bi-pin fluorescent lamp base to a recessed double contact base.

The adapter comprises an insulating housing having a disk-shaped base and a boss projecting therefrom. The boss has a central aperture and a pair of peripheral apertures, one on either side of the central aperture. These apertures are spaced apart a distance equal to the spacing of the bi-pins. An electrical contact is positioned in each of the peripheral apertures, each contact being fixed therein and including a portion which frictionally engages one of the base pins to provide electrical contact.

Employment of this adapter allows fluorescent lamps of several varieties to be made with the same base; i.e., a bi-pin. The bi-pin base is converted to the RDC type merely by the addition of the adapter, which is held in position by the frictional engagement of the contacts with the base pins.

BEST MODE FOR CARRYING OUT THE INVENTION

For a better understanding of the present invention, together with other and further objects, advantages and capabilities thereof, reference is made to the following disclosure and appended claims taken in conjunction with the above-described drawings.

Figure 1:
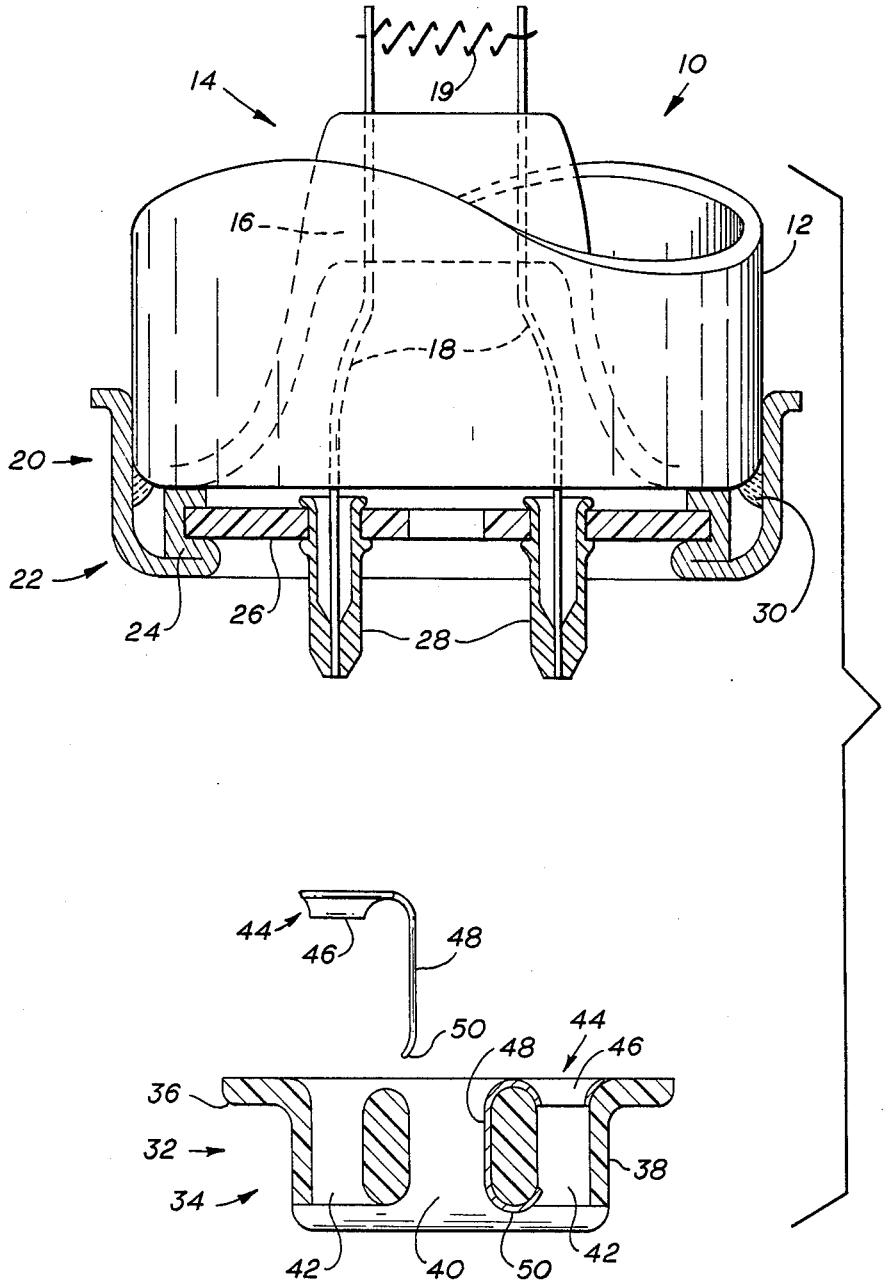
FIG. 1 is an exploded, elevational view of an embodiment of the invention.
Figure 2:
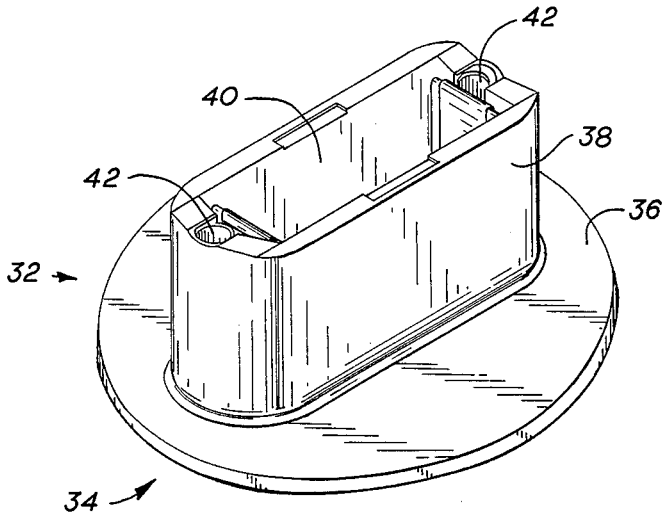
FIG. 2 is a perspective view of an adapter.

Referring now to the drawings with greater particularity, there is shown in FIG. 1 a lamp 10 comprising a tubular glass envelope 12 having a mount 14 sealed therein at each end thereof (only one end being shown). The mount 14 includes a stem press 16 within which a pair of lead-wires 18 are sealed. A filamentary electrode 19 is mounted on the inner ends of lead-wires 18 within the tubular glass envelope 12.

The lamp 10 is provided with a base 20 at each end thereof. The base comprises a metal shell 22, provided with an annular flange 24 which locks disk 26 of insulating material thereto. A pair of base pins 28 are staked to the disk 26 to form the bi-pin base.

In assembling the base to the lamp, the lead-wires 18 are threaded into the base pins 28 and welded or soldered thereto and the shell 22 of the base is secured to the end of the lamp envelope by basing cement 30.

The recessed double contact adapter 32 comprises an insulating housing 34 having a disk-shaped base 36 with a boss 38 projecting therefrom. A central aperture 40 is provided within boss 38, as is a pair of peripheral apertures 42, one on either side of central aperture 40. The peripheral apertures 42 are spaced apart a distance equal to the spacing of pins 28.

An electrical contact 44 is positioned in each aperture 42. Each contact 44 includes a hollow frustum 46 which frictionally engages a base pin 28 and a projecting portion 48 which extends along an inside wall of central aperture 40. A terminal portion 50 of projecting portion 48 is bent over to maintain the contact 44 within the aperture 42.

Preferably, the disk-shaped base 36 has a diameter equal to that of insulating disk 26.

There is thus provided a convenient adapter for converting a bi-pin base to a recessed double contact base.

While there has been shown and described what is at present considered to be the preferred embodiment of the invention, it will be apparent to those skilled in the art that various changes and modifications can be made herein without departing from the scope of the invention as defined by the appended claims.

I claim:

1. An adapter for converting a fluorescent lamp bi-pin base to a recessed double contact base, said bi-pin base comprising a shell; a disk of insulating material secured to said shell; and a pair of base pins mounted on said disk, said pins being formed to receive the lead wires from a fluorescent lamp, said adapter comprising:

an insulating housing having a disk-shaped base and a boss projecting therefrom;

a central aperture in said boss;

a pair of peripheral apertures in said boss, one on either side of said central aperture and having a spacing corresponding to the spacing of said pair of base pins; and an electrical contact in each of said peripheral apertures, each of said contacts being fixed therein and including a portion which frictionally engages a base pin to provide electrical contact.

2. The adapter of claim 1 wherein said portion which frictionally engages said base pin is configured as a hollow frustum.

3. The adapter of claim 2 wherein said electrical contact includes a projecting portion which extends within said central aperture.

4. The adapter of claim 1 wherein said disk of insulating material has a given diameter and said disk-shaped base has substantially the same diameter.

* * * * *